US012342844B2

(12) United States Patent
Lamblin et al.

(10) Patent No.: US 12,342,844 B2
(45) Date of Patent: Jul. 1, 2025

(54) RECONSTITUTED PLANT WITH PLANT EXTRACT FOR DEVICES THAT HEAT TOBACCO WITHOUT BURNING IT

(71) Applicant: SWM Holdings US, LLC, Atlanta, GA (US)

(72) Inventors: Linda Lamblin, Spay (FR); Stéphane Rouillard, Spay (FR); Meng Jun Qian, Spay (FR)

(73) Assignee: SWM Holdings US, LLC, Atlanta, GA (US)

( * ) Notice: Subject to any disclaimer, the term of this patent is extended or adjusted under 35 U.S.C. 154(b) by 305 days.

(21) Appl. No.: 16/643,035

(22) PCT Filed: Aug. 30, 2018

(86) PCT No.: PCT/EP2018/073389
§ 371 (c)(1),
(2) Date: Feb. 28, 2020

(87) PCT Pub. No.: WO2019/043119
PCT Pub. Date: Mar. 7, 2019

(65) Prior Publication Data

US 2020/0205463 A1 Jul. 2, 2020

(30) Foreign Application Priority Data

Aug. 30, 2017 (FR) ..... 1757991

(51) Int. Cl.
*A24B 3/14* (2006.01)
*A24B 15/12* (2006.01)
*A24B 15/16* (2020.01)
*A24B 15/167* (2020.01)

(52) U.S. Cl.
CPC ..... *A24B 15/167* (2016.11); *A24B 3/14* (2013.01); *A24B 15/12* (2013.01); *A24B 15/16* (2013.01)

(58) Field of Classification Search
CPC ..... A24B 3/14; A24B 15/12; A24B 15/16
USPC ..... 131/356
See application file for complete search history.

(56) References Cited

U.S. PATENT DOCUMENTS

| | | | | | |
|---|---|---|---|---|---|
| 25,604 | A * | 9/1859 | Dixon | A24B 15/12 | 131/358 |
| 3,369,552 | A * | 2/1968 | Carroll | A24B 15/16 | 131/369 |
| 3,820,548 | A | 6/1974 | Buchmann et al. | | |
| 3,867,951 | A * | 2/1975 | Buchmann | A24B 15/16 | 131/359 |
| 4,186,757 | A * | 2/1980 | Bornsztein | A24C 1/04 | 131/370 |
| 5,119,836 | A * | 6/1992 | White | A24B 15/12 | 131/369 |
| 5,715,844 | A | 2/1998 | Young et al. | | |
| 5,724,998 | A | 3/1998 | Gellatly et al. | | |
| 6,109,272 | A * | 8/2000 | Saito | A24B 15/24 | 131/357 |
| 7,428,905 | B2 * | 9/2008 | Mua | A24B 3/14 | 131/364 |
| 9,155,772 | B2 * | 10/2015 | Gao | A24B 13/00 | |
| 9,930,910 | B2 * | 4/2018 | Gindrat | A24D 1/22 | |
| 10,342,251 | B2 | 7/2019 | Beeson et al. | | |
| 10,791,756 | B2 * | 10/2020 | Zuchuat | A24B 15/14 | |
| 10,881,132 | B2 * | 1/2021 | Mua | A24B 15/18 | |
| 11,019,850 | B2 * | 6/2021 | Sebastian | A24B 13/02 | |
| 2005/0056294 | A1 * | 3/2005 | Wanna | A24B 3/14 | 131/370 |
| 2012/0031415 | A1 * | 2/2012 | Essen | A24B 15/16 | 131/369 |
| 2017/0164651 | A1 * | 6/2017 | Mua | A24B 15/10 | |

FOREIGN PATENT DOCUMENTS

| | | | |
|---|---|---|---|
| GB | 1413177 | A | 11/1975 |
| WO | WO2016/026810 | A1 | 2/2016 |
| WO | WO2016/207407 | A1 | 12/2016 |
| WO | WO2017/051034 | A1 | 3/2017 |
| WO | WO2017/097840 | A1 | 6/2017 |

OTHER PUBLICATIONS

Cotton, USDA Coexistence Fact Sheet, Office of Communications, United States Department of Agriculture, https://www.usda.gov/sites/default/files/documents/coexistence-cotton-factsheet.pdf (Year: 2015).*

2011 Cost Estimates of Producing Fresh Market Field-Grown Head Lettuce in Western WA, WA State University Extension Fact Sheet, Washington State University, https://s3.wp.wsu.edu/uploads/sites/2073/2014/09/2011-Costs-Estimates-of-Producing-Fresh-Market-Field-Grown-Head-Lettuce-in-Western-Washington (Year: 2012).*

International Search Report Corresponding to Application No. PCT/EP2018/073389 on Nov. 7, 2018.

Japanese Office Action Corresponding to Application No. 2020512600 on Sep. 9, 2022.

* cited by examiner

*Primary Examiner* — Russell E Sparks
(74) *Attorney, Agent, or Firm* — Dority & Manning, P.A.

(57) ABSTRACT

The invention relates to a reconstituted plant leaf comprising plant fibres and a plant extract other than the tobacco plant suitable for devices that heat tobacco without burning it.

13 Claims, No Drawings

RECONSTITUTED PLANT WITH PLANT EXTRACT FOR DEVICES THAT HEAT TOBACCO WITHOUT BURNING IT

RELATED APPLICATIONS

This application is the national stage entry and claims priority to International Patent Application No. PCT/EP2018/073389 having a filing date of Aug. 30, 2018, which claims the filing benefit of FR 1757991 having a filing date of Aug. 30, 2017.

The invention is in the field of devices that heat tobacco without burning it and relates to a reconstituted plant leaf suitable for these heating devices and comprising a fibrous substrate obtained by a papermaking process comprising plant fibres, an aerosol-generating agent and, optionally, a plant extract and/or tobacco extract, the plant not being a tobacco plant.

A large number of tobacco heating devices have been developed for avoiding the formation of harmful constituents during combustion of tobacco. We may mention as examples the applications published under numbers WO 2016/026810 and WO 2016/207407, which describe such devices. In these devices, tobacco is heated to a temperature below the combustion temperature without being burnt, which leads to the formation of an aerosol. The aerosol generated during the heating of the tobacco replaces cigarette smoke, has interesting organoleptic properties and is inhaled by the user. This thus allows users to inhale the tobacco aromas while very significantly reducing their exposure to the harmful constituents.

Conventional tobacco is not suitable for such devices, as it does not make it possible to generate a large amount of aerosol having interesting organoleptic properties. The reconstituted tobacco is more suitable for these heating devices, as it makes it possible to generate a large amount of aerosol having interesting organoleptic properties.

It may be advantageous to offer the user of these heating devices aromas that are different from those of tobacco.

The inventors have therefore developed a reconstituted plant leaf comprising:

a fibrous substrate comprising plant fibres, and an aerosol-generating agent, characterized in that the plant is not a tobacco plant and the aerosol-generating agent represents from 8 to 50% by weight of the dry matter of the leaf.

Advantageously, the fibrous substrate comprises aromatic compounds so that the aerosol generated by heating the reconstituted plant leaf has interesting organoleptic properties for the user.

Moreover, the aerosol-generating agent is distributed in a controlled, uniform manner on the reconstituted plant leaf according to the invention. Owing to said control and uniformity, the organoleptic properties of the aerosol generated by heating the reconstituted plant leaf are satisfactory for the user.

As used herein, the term "fibrous substrate" denotes a base web comprising refined non-tobacco and/or tobacco plant fibres, the base web being obtained by a papermaking process.

The aerosol-generating agent is a compound that allows an aerosol to form when it is heated for example in contact with hot air.

Typically the aerosol-generating agent may be a polyol, a non-polyol or a mixture thereof. Typically a polyol generating agent may be sorbitol, glycerol, propylene glycol, triethylene glycol or a mixture thereof. Typically a non-polyol generating agent may be lactic acid, glyceryl diacetate, glyceryl triacetate, triethyl citrate or isopropyl myristate or a mixture thereof.

According to one embodiment, the aerosol-generating agent is glycerol, propylene glycol, or a mixture of glycerol and propylene glycol, glycerol being preferred.

According to one embodiment, the aerosol-generating agent represents from 10 to 40%, in particular from 12 to 30%, more particularly from 15 to 25% by weight of the dry matter of the leaf.

According to one embodiment, the fibrous substrate comprises an extract selected from a plant extract, a tobacco extract or a mixture thereof.

The plant extract corresponds to all of the water-soluble products of the plant. Advantageously the plant extract comprises the compounds endowing the aerosol with organoleptic and/or therapeutic properties.

The tobacco extract corresponds to all of the water-soluble products of tobacco. It may be obtained by concentrating the water-soluble products of tobacco. The water-soluble products of tobacco advantageously comprise the compounds allowing the user to be offered the tobacco aromas.

It may be advantageous to control the content by weight of dry matter of the extract contained in the leaf of the invention. In fact the organoleptic and/or therapeutic properties of the aerosol formed by heating the leaf depend in part on this content.

The content by weight of dry matter of the extract contained in the leaf of the invention is determined by controlling the amount of extract incorporated during manufacture of said leaf.

The following method may be used for determining the content by weight of dry matter of the extract contained in the leaf of the invention:

The leaf to be analysed is ground to give a granulometry less than or equal to 1 mm. The ground leaf is then mixed with boiling water for 45 minutes to extract the extract. The content by weight of dry matter of the extract is calculated by difference between the dry weight of the sample of leaf to be analysed and the dry weight of the fibrous residue after extraction.

According to one embodiment the content by weight of dry matter of the extract contained in the leaf of the invention is below 57%, in particular from 7% to 55% more particularly from 12 to 50%.

According to this embodiment the content by weight of dry matter of extract and of aerosol-generating agent in the leaf of the invention is from 8 to 65%, in particular from 10% to 55% more particularly from 20 to 50%.

According to a specific embodiment, the content by weight of dry matter of the extract contained in the leaf of the invention is below 47%, in particular from 7% to 46%, more particularly from 12% to 45%.

According to this specific embodiment, the content by weight of dry matter of the extract and of aerosol-generating agent in the leaf of the invention is below 8% to 55%, in particular from 10% to 46%, more particularly from 20% to 45%.

The content by weight of dry matter of the plant extract depends on the plant used and, more particularly, on the content of aromatic compounds or of compounds having the therapeutic properties of the plant used.

Let $S_P$ be the content by weight of dry matter of the plant extract contained in the leaf of the invention. Typically $S_P$ may be below 47%, in particular from 7% to 46%, more particularly from 12% to 45%.

The content by weight of dry matter of the tobacco extract depends on the tobacco used and more particularly on the content of aromatic compounds of the tobacco used.

Let $S_T$ be the content by weight of dry matter of the tobacco extract contained in the leaf of the invention. Typically $S_T$ may be below 47%, in particular from 7% to 46%, more particularly from 12% to 45%.

According to a particular embodiment the content of tobacco extract $S_T$ is about 15%, 17% or 21%.

Typically the weight ratio $S_F$:$S_T$ may be from 95:5 to 5:95, in particular from 75:25 to 25:75, more particularly from 60:40 to 40:60, even more particularly 50:50.

According to a specific embodiment, the weight ratio $S_F$:$S_T$ may be from 10:90 to 30:70.

Typically the plant fibres may represent from 30% to 92% by weight of dry matter of the reconstituted plant leaf, in particular from 40% to 75% by weight of dry matter of the reconstituted plant leaf, more particularly from 50% to 60% by weight of dry matter of the reconstituted plant leaf.

Typically the reconstituted plant leaf has a basis weight below 200 g/m$^2$, in particular from 20 g/m$^2$ to 150 g/m$^2$, more particularly from 40 g/m$^2$ to 140 g/m$^2$, even more particularly from 60 g/m$^2$ to 125 g/m$^2$.

According to one embodiment, the fibrous substrate of the reconstituted leaf further comprises particles selected from plant particles, tobacco particles or a mixture thereof.

As used herein, the term "particles" denotes particles having a size from 0.01 μm to 200 μm, in particular from 0.025 μm to 100 μm, even more particularly from 0.05 μm to 50 μm. Advantageously the plant particles comprise the compounds endowing the aerosol with organoleptic and/or therapeutic properties. Advantageously the tobacco particles comprise the compounds endowing the aerosol with organoleptic properties.

Typically, the content by weight of dry matter of particles in the leaf of the invention is from 0.1% to 70%, in particular from 5% to 65%, more particularly from 12% to 60%.

According to one embodiment, the plant fibres are partially replaced with tobacco fibres. According to this embodiment the reconstituted plant leaf is a mixed reconstituted plant leaf comprising:

a fibrous substrate comprising plant fibres and tobacco fibres, and an aerosol-generating agent, characterized in that the plant is not a tobacco plant and the aerosol-generating agent represents from 8 to 50% by weight of the dry matter of the leaf.

Typically the plant fibres and the tobacco fibres may represent from 30% to 92% by weight of dry matter of the mixed reconstituted plant leaf, in particular from 40% to 75% by weight of dry matter of the mixed reconstituted plant leaf, more particularly from 50% to 60% by weight of dry matter of the mixed reconstituted plant leaf.

Let $R_f$ be the ratio by weight of plant fibres to tobacco fibres in the mixed reconstituted plant leaf.

The ratio by weight $R_F$ depends on the plant, in particular on the plant parts used, and more particularly on the mechanical strength properties of the plant fibres. Typically the ratio by weight $R_F$ in the mixed reconstituted plant leaf may be from 90:10 to 10:90, in particular from 75:25 to 25:75, more particularly from 45:55 to 55:45, even more particularly 50:50.

Typically the mixed reconstituted plant leaf has a basis weight below 200 g/m$^2$, in particular from 20 g/m$^2$ to 150 g/m$^2$, more particularly from 40 g/m$^2$ to 140 g/m$^2$, even more particularly from 60 g/m$^2$ to 125 g/m$^2$.

According to one embodiment, the fibrous substrate of the mixed reconstituted plant leaf comprises an extract. The extract is as described above in relation to the reconstituted plant leaf.

According to one embodiment, the fibrous substrate of the mixed reconstituted plant leaf further comprises particles. The particles are as described above in relation to the reconstituted plant leaf.

According to one embodiment, the plant fibres are replaced completely with tobacco fibres. According to this embodiment the reconstituted plant leaf is a mixed reconstituted leaf comprising:

a fibrous substrate comprising tobacco fibres, an aerosol-generating agent, and a plant extract, characterized in that the aerosol-generating agent represents from 8 to 50% by weight of the dry matter of the leaf.

The plant extract of the mixed reconstituted leaf is as described above in relation to the reconstituted plant leaf.

Typically the tobacco fibres may represent from 30% to 92% by weight of dry matter of the mixed reconstituted leaf, in particular from 40% to 75% by weight of dry matter of the mixed reconstituted leaf, more particularly from 50% to 60% by weight of dry matter of the mixed reconstituted leaf.

Typically the mixed reconstituted leaf has a basis weight below 200 g/m$^2$, in particular from 20 g/m$^2$ to 150 g/m$^2$, more particularly from 40 g/m$^2$ to 140 g/m$^2$, even more particularly from 60 g/m$^2$ to 125 g/m$^2$.

According to one embodiment, the fibrous substrate of the mixed reconstituted leaf further comprises a tobacco extract. The tobacco extract of the mixed reconstituted leaf is as described above in relation to the reconstituted plant leaf.

According to one embodiment, the fibrous substrate of the mixed reconstituted leaf further comprises particles. The particles of the mixed reconstituted leaf are as described above in relation to the reconstituted plant leaf.

Owing to the tobacco fibres, the mixed reconstituted plant leaf and the mixed reconstituted leaf may allow formation of an aerosol having organoleptic properties different from the aerosol formed by heating the reconstituted plant leaf and may therefore offer the user different aromas.

The plant fibres, the plant extract and the plant particles may be obtained from a plant, other than a tobacco plant, selected from spore-producing plants, seed-producing plants or a mixture thereof. In particular, the plant is a seed-producing plant selected from food plants, aromatic plants, perfume plants, medicinal plants, plants of the family Cannabaceae, or a mixture thereof.

Advantageously, a plant extract and the plant particles obtained from a mixture of plants make it possible to offer a wide panel of organoleptic properties. A mixture of plants also makes it possible to counterbalance the unpleasant organoleptic properties of a plant, for example a medicinal plant, with the pleasant organoleptic properties of a plant, for example of an aromatic plant or perfume plant.

Advantageously, mixing plants to obtain plant fibres makes it possible to adapt the mechanical properties of the reconstituted plant leaf and/or the organoleptic or chemical properties of the aerosol.

Typically the food plants are garlic, coffee, cinnamon, fennel, ginger, liquorice, star anise, rooibos, Stevia rebaudiana, tea, cacao tree, chamomile, mate.

Typically the aromatic plants are basil, curcuma, clove tree, bay, oregano, mint, rosemary, sage, thyme, savory.

Typically the perfume plants are lavender, rose, eucalyptus.

Typically the medicinal plants are those given in the document, list A of medicinal plants used traditionally (French Pharmacopoeia January 2016, published by the National Agency for Safety of Medicines (Agence Nationale de Sécurité du Médicament, ANSM)) or plants known to comprise chemical compounds having therapeutic properties. Typically the medicinal plants listed are ginkgo, ginseng, morello cherry tree, peppermint, willow and red vine.

Typically the medicinal plants known to comprise chemical compounds having therapeutic properties include eucalyptus.

If the plant is a medicinal plant, the reconstituted plant leaf may have therapeutic properties. It can therefore be used for therapeutic treatment.

According to a particular embodiment the plant is eucalyptus, fennel, star anise, mint or peppermint.

Typically the plant fibres, the plant extract and the plant particles may be derived from different plant parts, the plant parts being the plant parts themselves or the result of processing various plant parts. Typically the plant parts may be whole plant parts or debris derived from threshing or mixing and chopping of the plant parts.

Typically the plant fibres may be obtained from a first plant, the plant extract may be obtained from a second plant and the plant particles may be obtained from the second plant or from a third plant. In fact, the fibres of a plant might not endow the aerosol with organoleptic properties, nevertheless the extract and/or the particles of this plant may endow the aerosol with organoleptic properties and/or therapeutic properties. Conversely, the fibres of a plant may endow the aerosol with organoleptic properties, whereas the extract and/or the particles of this plant may not offer required organoleptic properties and/or therapeutic properties.

Typically the plant parts may be the plant parts richest in compounds that reinforce the organoleptic properties of the aerosol formed on heating the reconstituted plant leaf. Typically these parts may be the whole plant, the aerial plant parts such as the flower bud, branch bark, stem bark, leaves, the flower, the fruit and its peduncle, seed, petal, flower head, or the underground parts, for example bulb, roots, root bark, rhizome or a mixture thereof. The plant part may also be the result of mechanical, biological, chemical or mechanical-chemical processing of one or more plant parts, such as for example the shell protecting the cocoa bean resulting from the bean dehulling process.

For example, among the food plants, the garlic bulb, the coffee "cherry", the rhizome of ginger, the liquorice root, the fruit of star anise, of fennel and the leaves of the rooibos, of Stevia rebaudiana, or of tea may be the parts selected.

Among the aromatic plants, the parts selected may be, for example, the flower buds of the clove tree (the cloves), the leaves of basil, of bay and of sage, the leaves and flower head of mint, of oregano, of rosemary and of thyme, or the rhizome of curcuma.

Typically among the perfume plants, we may select the flower and the flower head of lavender, or the flower bud and petals of the rose.

Among the medicinal plants listed in the French Pharmacopoeia, we may select, for example, the leaf of ginkgo, the underground part of ginseng, the peduncle of the fruit (cherry stalk) of the morello cherry tree, the leaves and the flower head of peppermint, the stem bark and the leaves of the willow, or the leaves of the red vine.

Typically the water-soluble products of the plant and the plant fibres are obtained by a dissociation method. In such a method, one or more plant parts are mixed with water, for example in a digester, in order to extract the water-soluble products of the plant. The water-soluble products of the plant are then separated from the plant fibres, for example by passing through a screw press, to isolate and obtain, on the one hand, the plant fibres and, on the other hand, the water-soluble products of the plant. In a dissociation method of this kind, the plant fibres are therefore dissociated from the water-soluble products of the plant in order to process them separately.

Typically the temperature of the water for extracting the water-soluble products of the plant may be adjusted to the plant parts to be treated. For example, the temperature of the water is higher when treating a root or bark than when treating leaves or petals.

Typically the temperature of the water may be from 30° C. to 100° C., in particular from 40° C. to 90° C., more particularly from 50° C. to 80° C.

Typically the plant extract is obtained from the water-soluble products of the plant obtained by the dissociation process, for example by concentrating them in a device such as a vacuum evaporation device.

The tobacco fibres may be obtained from any tobacco plant (for example from Virginia tobacco, Burley tobacco, air-cured tobacco, dark air-cured tobacco, Orient tobacco, sun-cured tobacco, fire-cured tobacco or tobacco mixtures). Typically the tobacco fibres result from the treatment of one tobacco plant or of various tobacco plants.

Typically the tobacco fibres may be obtained from different parts of the tobacco plant. The parts of the tobacco plant may be parts of the tobacco plant themselves or the result of processing various parts of the tobacco plant. Typically the parts of the tobacco may be the parts of the tobacco plant richest in compounds that reinforce the organoleptic properties of the aerosol formed on heating the reconstituted mixed leaf. Typically the parts of the tobacco plant may be the tobacco stalk, the parenchyma (lamina) optionally with added stems of the tobacco plant. Typically the parts of the tobacco plant may be the leaves of the tobacco plant or the debris derived from threshing or mixing and chopping leaves and veins of the tobacco plant to produce scaferlati (cut tobacco).

The tobacco fibres may be obtained by a dissociation process similar to that described above in relation to plant fibres. Thus, the part or parts of the tobacco plant selected are mixed with water, for example in a digester, in order to dissociate the tobacco fibres from the water-soluble products of tobacco.

Typically the temperature of the water may be adapted to the part or parts of the tobacco plant. Typically the temperature of the water may be between 30° C. and 90° C., for example between 30° C. and 70° C. or between 50° C. and 90° C. Typically for treating the stems of a tobacco plant, the temperature of the water may be between 50° C. and 90° C. Typically for treating parenchymas (laminae) of a tobacco plant, the temperature of the water may be between 30° C. and 70° C.

Typically the fibrous substrate of the reconstituted plant leaf, of the mixed reconstituted plant leaf or of the mixed reconstituted leaf may further comprise cellulosic plant fibres.

The cellulosic plant fibres are fibres obtained by a chemical or mechanical or thermo-mechanical cooking process such as wood pulp, hemp, or of annual plants such as flax or perennials such as sisal for example. A mixture of these cellulosic plant fibres may also be used.

Advantageously, these cellulosic plant fibres may improve the mechanical strength properties of the reconstituted plant leaf.

Typically the cellulosic plant fibres may represent from 0% to 15%, in particular from 5% to 10%, more particularly 8% by weight of dry matter of the reconstituted plant leaf, of the mixed reconstituted plant leaf or of the mixed reconstituted leaf.

The reconstituted plant leaf according to the invention is manufactured by a papermaking process comprising the following steps:

- the refined plant fibres are passed through a papermaking machine to constitute a plant base web;
- the aerosol-generating agent and, optionally, the extract are incorporated in the plant base web to produce the reconstituted plant leaf according to the invention.

The mixed reconstituted plant leaf according to the invention is manufactured by a similar papermaking process, the difference being that the refined tobacco fibres are mixed with the refined plant fibres before or during passage through the papermaking machine to constitute a mixed base web. The aerosol-generating agent and, optionally, the extract are then incorporated in the mixed plant base web to produce the mixed reconstituted plant leaf according to the invention.

The mixed reconstituted leaf according to the invention is manufactured by a similar papermaking process, the difference being that the refined tobacco fibres are passed through the papermaking machine instead of the refined plant fibres to constitute a tobacco base web. The plant extract, the aerosol-generating agent and, optionally, the tobacco extract are then incorporated in the tobacco base web to produce the mixed reconstituted leaf according to the invention.

Typically the extract and the aerosol-generating agent may be incorporated by impregnation or spraying, preferably by impregnation, in the plant base web, in the mixed plant base web or in the tobacco base web. Typically impregnation may be carried out using a size press.

Advantageously, these techniques allow controlled, uniform incorporation of the extracts and aerosol-generating agent. Owing to this control and uniformity, the organoleptic properties of the aerosol formed by heating the reconstituted plant leaf, the mixed reconstituted plant leaf or the mixed reconstituted leaf are constant, so as not to cause frustration for the user.

Typically the extract and the aerosol-generating agent may be incorporated one after another, or may be mixed to be incorporated together in the plant base web, the mixed plant base web or the tobacco base web.

Typically the particles may be mixed to the refined plant fibres before said refined plant fibres are passed through a papermaking machine to constitute the plant base web.

Typically the particles may be mixed to the mixture of refined plant fibres and refined tobacco fibres before said mixture of refined fibres is passed through a papermaking machine to constitute the mixed base web Typically the particles may be mixed to the refined tobacco fibres before said refined tobacco fibres are passed through a papermaking machine to constitute the tobacco base web.

Typically the refined plant fibres, the refined tobacco fibres or the mixture of refined plant fibres and refined tobacco fibres pass through a refiner. The refined plant fibres and the refined tobacco fibres may also be mixed to obtain mixed refined fibres. The refined plant fibres and the refined tobacco fibres may then be passed through the papermaking machine to constitute, respectively, the plant base web and the tobacco base web. The mixed base web is constituted by passing the mixture of refined fibres or the mixed refined fibres through the papermaking machine.

According to a particular embodiment, one or more parts of the tobacco plant and one or more parts of the non-tobacco plant are mixed together with water, for example in a digester, in order to extract the water-soluble products of the tobacco plant and the water-soluble products of the non-tobacco plant. The water-soluble products are then separated from the tobacco fibres and the non-tobacco plant fibres, for example by passing through a screw press, to obtain on the one hand a mixture of tobacco fibres and non-tobacco plant fibres and, on the other hand, a mixture of the water-soluble tobacco and non-tobacco plant products. In such a method, the mixture of fibres is therefore dissociated from the mixture of water-soluble products in order to process them separately. Typically all or part of the water-soluble products may then be concentrated to obtain an extract, mixture of tobacco extract and of plant extract. Starting from the mixture of fibres and the extract, it is then possible to manufacture, by the papermaking process, the mixed reconstituted plant leaf. This is very advantageous as, by adjusting the initial amounts of the part or parts of the tobacco plant and the part or parts of the non-tobacco plant, it is possible to obtain the mixed reconstituted plant leaf directly without employing, in parallel, two methods of dissociation of fibres and extracts, one for the tobacco plant and another for the plant.

Typically the reconstituted plant leaf, the mixed reconstituted plant leaf and the mixed reconstituted leaf may be mixed, two at a time or three at a time, to form a blend of reconstituted leaves. The proportions of the different leaves in the blend of reconstituted leaves will depend on the organoleptic properties required.

Advantageously, the blend of reconstituted leaves may offer a large panel of aromas to the user or, for example, may counterbalance the unpleasant aroma of a medicinal plant with the aroma of tobacco or the pleasant aroma of an aromatic plant or perfume plant.

Typically, conventional tobacco may be mixed with a leaf selected from the reconstituted plant leaf, the mixed reconstituted plant leaf, the mixed reconstituted leaf, the mixture of reconstituted leaf or a mixture thereof to form a mixture of reconstituted leaves/tobacco. The proportions of the different constituents of the blend of reconstituted leaves/tobacco will depend on the organoleptic properties required.

The reconstituted plant leaf, the mixed reconstituted plant leaf, the mixed reconstituted leaf, the mixture of reconstituted leaf and the blend of reconstituted leaves/tobacco may then be cut into thin sheets similar to strips of tobacco.

The reconstituted plant leaf, the mixed reconstituted plant leaf, the mixed reconstituted leaf, and the mixture of reconstituted leaf may then be rolled into a roll that will then be cut into reels.

Typically the reconstituted plant leaf, the mixed reconstituted plant leaf, the mixed reconstituted leaf, the blend of reconstituted leaves or the blend of reconstituted leaves/tobacco may be used in a heating device.

As used herein, the term "heating device" denotes any device allowing the formation of an aerosol intended to be inhaled by a consumer. Typically a device that heats tobacco without burning it is a heating device.

Typically a heating device comprises, in the direction of the air flow, an air inlet, a heating element, a chamber intended to receive and hold an aerosol-generating substrate selected from the reconstituted plant leaf, the mixed reconstituted leaf, the blend of reconstituted leaves or the blend of reconstituted leaves/tobacco in the form of a strand, of fragments or of crêped sheet, and an air outlet intended to be put in the user's mouth. The air inlet, the heating element, the chamber, and the air outlet are typically connected together at least fluidically.

Typically, when using the heating device, air is aspirated by the user into the heating device via the air inlet; the aspirated air then passes through the heated part to obtain heated air; in contact with the aerosol-generating substrate held in the chamber, an aerosol is formed by the heated air and is then inhaled by the user.

As the plant extracts and optionally the tobacco extracts are contained in the aerosol formed, said aerosol therefore has organoleptic properties of the plant and optionally of tobacco.

Moreover, with this heating device there is no combustion of the leaf. The user may therefore have the benefit of the organoleptic properties of the plant, and optionally of tobacco while very significantly reducing his or her exposure to the harmful constituents.

EXAMPLES

Example 1

The Plant is Eucalyptus

Example 1a: Reconstituted Eucalyptus Leaf

A mixture of eucalyptus leaves is brought into contact with water in the laboratory in a water bath at 85° C. with manual stirring for 30 minutes. The water-soluble products of eucalyptus are separated from the eucalyptus fibres by mechanical pressing. The water-soluble products of eucalyptus are concentrated under vacuum to a concentration of dry matter of 65%.

Eucalyptus fibres and 8% of cellulose fibres are passed through a laboratory papermaking machine to obtain a base web with a basis weight of about 64 g/m$^2$. The concentrated water-soluble products of eucalyptus are mixed with glycerol, and then this mixture is added onto the base web by impregnation in a size press so as to obtain a reconstituted eucalyptus leaf. The content by weight of dry matter of eucalyptus extract in the reconstituted eucalyptus leaf is 25% and the content by weight of glycerol represents 20% by weight of the dry matter of the reconstituted eucalyptus leaf.

The reconstituted eucalyptus leaf obtained has a basis weight of 110 g/m$^2$.

The reconstituted eucalyptus leaf obtained is dried and cut into scaferlati to be heated in a heating device for generating aerosol without combustion. The organoleptic properties of the aerosol thus generated are satisfactory for the user.

Example 1b: Mixed Reconstituted Eucalyptus Leaf

A mixture of 50% of eucalyptus leaves and 50% of tobacco leaves and veins of the Virginia type is brought into contact with water in the laboratory in a water bath at 85° C. with manual stirring for 30 minutes. The water-soluble products of the eucalyptus/tobacco mixture are separated from the fibres of the eucalyptus/tobacco mixture by mechanical pressing. The water-soluble products of the mixture are concentrated under vacuum to a concentration of dry matter of 59%.

The fibres of the mixture and 8% of cellulose fibres are refined and are passed through a laboratory papermaking machine to obtain a mixed base web with a basis weight of about 64 g/m$^2$. The concentrated water-soluble products of the mixture are mixed with glycerol, and this mixture is then added to the mixed eucalyptus base web by impregnation in a size press to obtain a mixed reconstituted eucalyptus leaf. The content by weight of dry matter of the mixture of extract in the mixed reconstituted eucalyptus leaf is 25% and the content by weight of glycerol represents 20% by weight of the dry matter of the reconstituted eucalyptus leaf.

The mixed reconstituted eucalyptus leaf obtained has a basis weight of 110 g/m$^2$.

The mixed reconstituted eucalyptus leaf obtained is dried and cut into scaferlati to be heated in an aerosol-generating heating device. The organoleptic properties of the aerosol thus generated are satisfactory for the user.

Example 1c: Mixed Reconstituted Leaf

A mixture of tobacco lamina of the Virginia, Burley, or Orient type is brought into contact with water in the laboratory in a water bath at 85° C. with manual stirring for 30 minutes. The water-soluble products of tobacco are separated from the tobacco fibres by mechanical pressing. The water-soluble products of tobacco are concentrated under vacuum to a concentration of dry matter of 59%.

A mixture of eucalyptus leaves is brought into contact with water in the laboratory in a water bath at 85° C. with manual stirring for 30 minutes. The water-soluble products of eucalyptus are separated from the eucalyptus fibres by mechanical pressing. The water-soluble products of eucalyptus are concentrated under vacuum to a concentration of dry matter of 65%.

The tobacco fibres and 8% of cellulose fibres are passed through a laboratory papermaking machine to obtain a tobacco base web with a basis weight of about 64 g/m$^2$. The mixture of concentrated water-soluble products, 50% eucalyptus and 50% tobacco, is mixed with glycerol, and this mixture is then added onto the tobacco base web by impregnation in a size press. The content by weight of dry matter of extract in the mixed reconstituted leaf is 25% and the glycerol represents 20% by weight of the dry matter of the mixed reconstituted leaf.

The mixed reconstituted leaf obtained has a basis weight of 110 g/m$^2$.

The mixed reconstituted leaf obtained is dried and cut into scaferlati to be smoked without combustion. The organoleptic properties of the aerosol thus generated are constant, which does not cause frustration for the user.

Example 1d: Mixed Reconstituted Eucalyptus Leaf

A mixture of eucalyptus leaves is brought into contact with water in the laboratory in a water bath at 40° C. with manual stirring for 30 minutes. The water-soluble products of eucalyptus are separated from the eucalyptus fibres by mechanical pressing. The water-soluble products of eucalyptus are concentrated under vacuum to a concentration of dry matter of 47%.

A mixture of tobacco lamina of the Virginia, Burley, or Orient type is brought into contact with water in the laboratory in a water bath at 85° C. with manual stirring for 30 minutes. The water-soluble products of tobacco are separated from the tobacco fibres by mechanical pressing. The water-soluble products of tobacco are concentrated under vacuum to a concentration of dry matter of 59%.

The eucalyptus fibres and the tobacco fibres are mixed to obtain a mixture of fibres. The ratio by weight of eucalyptus fibres to tobacco fibres is 15:85.

The concentrated water-soluble products of eucalyptus and the concentrated water-soluble products of tobacco are mixed to obtain a mixture of concentrated water-soluble products. The weight ratio of dry matter of the concentrated water-soluble products of eucalyptus to the concentrated water-soluble products of tobacco is 7:93.

The mixture of fibres and 12% of cellulose fibres are passed through a laboratory papermaking machine to obtain a mixed base web with a basis weight of about 60 g/m$^2$. The mixture of concentrated water-soluble products, is mixed with glycerol, and this mixture is then added onto the mixed base web by impregnation in a size press. The content by weight of dry matter of extract in the mixed reconstituted eucalyptus leaf is 28% and the glycerol represents 20% by weight of the dry matter of the mixed reconstituted star anise leaf.

The mixed reconstituted eucalyptus leaf obtained has a basis weight of 105 g/m$^2$.

The mixed reconstituted eucalyptus leaf obtained is dried and cut into scaferlati to be smoked without combustion. The organoleptic properties of the aerosol thus generated are constant, which does not cause frustration for the user.

Example 1e: Reconstituted Eucalyptus Leaf with Eucalyptus Particles

A mixture of eucalyptus leaves is brought into contact with water in the laboratory in a water bath at 40° C. with manual stirring for 30 minutes. The water-soluble products of eucalyptus are separated from the eucalyptus fibres by mechanical pressing. The water-soluble products of eucalyptus are concentrated under vacuum to a concentration of dry matter of 47%.

Eucalyptus fibres, 20% of eucalyptus particles and 12% of cellulose fibres are passed through a laboratory papermaking machine to obtain a base web with a basis weight of about 70 g/m$^2$. The concentrated water-soluble products of eucalyptus are mixed with glycerol, and then this mixture is added onto the base web by impregnation in a size press so as to obtain a reconstituted eucalyptus leaf with eucalyptus particles. The content by weight of dry matter of eucalyptus extract in the reconstituted eucalyptus leaf is 28% and the content by weight of glycerol represents 20% by weight of the dry matter of the reconstituted eucalyptus leaf.

The reconstituted eucalyptus leaf with eucalyptus particles obtained has a basis weight of 110 g/m$^2$.

The reconstituted eucalyptus leaf with eucalyptus particles obtained is dried and cut into scaferlati to be smoked without combustion. The organoleptic properties of the aerosol thus generated are constant, which does not cause frustration for the user.

Example 2

The Plant is Mint

A reconstituted mint leaf is produced by a method identical to the method described in example 1a, with eucalyptus replaced with mint.

A mixed reconstituted mint leaf and a mixed reconstituted leaf comprising a mint extract are obtained by methods identical to the methods described in examples 1b and 1c, eucalyptus being replaced with mint.

These three leaves are dried and cut into scaferlati to be heated. The organoleptic properties of the aerosol thus generated are constant, which does not cause frustration for the user.

Example 3

The Plant is Star Anise

Example 3a: Reconstituted Star Anise Leaf

A mixture of star anise fruit is brought into contact with water in the laboratory in a water bath at 40° C. with manual stirring for 30 minutes. The water-soluble products of star anise are separated from the star anise fibres by mechanical pressing. The water-soluble products of star anise are concentrated under vacuum to a concentration of dry matter of 47%.

Star anise fibres and 12% of cellulose fibres are passed through a laboratory papermaking machine to obtain a base web with a basis weight of about 60 g/m$^2$. The concentrated water-soluble products of star anise are mixed with glycerol, and then this mixture is added onto the base web by impregnation in a size press so as to obtain a reconstituted star anise leaf. The content by weight of dry matter of star anise extract in the reconstituted star anise leaf is 28% and the content by weight of glycerol represents 20% by weight of the dry matter of the reconstituted star anise leaf.

The reconstituted star anise leaf obtained has a basis weight of 105 g/m$^2$.

The reconstituted star anise leaf obtained is dried and cut into scaferlati to be smoked without combustion. The organoleptic properties of the aerosol thus generated are constant, which does not cause frustration for the user.

Example 3b: Mixed Reconstituted Star Anise Leaf

A mixed reconstituted star anise leaf is obtained by a method identical to the method described in Example 1d, except that:

- eucalyptus leaves are replaced with star anise fruit,
- the ratio by weight of star anise fibres to tobacco fibres is 20:80, and
- the weight ratio of dry matter of the concentrated water-soluble products of star anise to the dry matter of the concentrated water-soluble products of tobacco is 10:90.

The mixed reconstituted star anise leaf obtained is dried and cut into scaferlati to be smoked without combustion. The organoleptic properties of the aerosol thus generated are constant, which does not cause frustration for the user.

Example 3c: Reconstituted Star Anise Leaf with Star Anise Particles

A reconstituted star anise leaf with bardian particles is obtained by a method identical to the method described in Example 1e, except that eucalyptus leaves are replaced with star anise fruit and eucalyptus particles are replaced with star anise particles.

The reconstituted star anise leaf with bardian particles obtained is dried and cut into scaferlati to be smoked without combustion. The organoleptic properties of the aerosol thus generated are constant, which does not cause frustration for the user.

Example 4

The Plant is Rooibos

A reconstituted rooibos leaf is obtained by a method identical to the method described in Example 3*a,* except that star anise fruit is replaced with rooibos leaves.

A mixed reconstituted rooibos leaf is obtained by a method identical to the method described in Example 3*b,* except that star anise fruit is replaced with rooibos leaves.

A reconstituted rooibos leaf with rooibos particles is obtained by a method identical to the method described in Example 1e, eucalyptus leaves being replaced with rooibos leaves and eucalyptus particles being replaced with rooibos particles.

The three exemplified reconstituted rooibos leaves obtained are dried and cut into scaferlati to be smoked without combustion. The organoleptic properties of the aerosol thus generated are constant, which does not cause frustration for the user.

Example 5

The Plant is Fennel

A reconstituted fennel leaf is obtained by a method identical to the method described in Example 3*a,* star anise fruit being replaced with fennel fruit.

A mixed reconstituted fennel leaf is obtained by a method identical to the method described in Example 1, except that eucalyptus leaves are replaced with fennel fruit.

A reconstituted fennel leaf with fennel particles is obtained by a method identical to the method described in Example 1e, eucalyptus leaves being replaced with fennel fruit and eucalyptus particles being replaced with fennel particles.

The three exemplified reconstituted fennel leaves obtained are dried and cut into scaferlati to be smoked without combustion. The organoleptic properties of the aerosol thus generated are constant, which does not cause frustration for the user.

Example 5

The Plant is Peppermint

A reconstituted peppermint leaf is obtained by a method identical to the method described in Example 3*a,* star anise fruit being replaced with the leaves and the flower head of peppermint.

A mixed reconstituted peppermint leaf is obtained by a method identical to the method described in Example 1d with:

eucalyptus being replaced with the leaves and the flower head of peppermint, the ratio by weight of peppermint fibres to tobacco fibres being 30:70, and the weight ratio of dry matter of the concentrated water-soluble products of peppermint to the dry matter of the concentrated water-soluble products of tobacco being 15:85.

A reconstituted peppermint leaf with peppermint particles is obtained by a method identical to the method described in Example 1e, eucalyptus leaves being replaced with the leaves and the flower head of peppermint and eucalyptus particles being replaced with peppermint particles.

The three exemplified reconstituted peppermint leaves obtained are dried and cut into scaferlati to be smoked without combustion. The organoleptic properties of the aerosol thus generated are constant, which does not cause frustration for the user.

The invention claimed is:

1. A reconstituted plant leaf comprising:

a fibrous substrate, wherein the fibrous substrate is a reconstituted base-web comprising refined plant fibers from a plant, wherein the reconstituted base-web is obtained by a papermaking process;

an aerosol-generating agent, and a plant extract from the same plant species as the refined plant fibers characterized in that the plant fibres represent from 30% to 92% by weight of dry matter of the reconstituted plant leaf, the plant extract represents from 12% to 46% by weight of dry matter of the reconstituted plant leaf, wherein all components of the plant extract are derived from a plant, the plant fibres and plant extract are not from a tobacco plant and the aerosol-generating agent represents from 10% to 50% by weight of the dry matter of the leaf.

2. The reconstituted plant leaf according to claim 1, in which the aerosol-generating agent is sorbitol, glycerol, propylene glycol, triethylene glycol, lactic acid, glyceryl diacetate, glyceryl triacetate, triethyl citrate, isopropyl myristate or a mixture thereof.

3. The reconstituted plant leaf according to claim 1, in which the fibrous substrate further comprises a tobacco extract, wherein the ratio of the content by weight of dry matter of the plant extract contained in the reconstituted plant leaf to the content by weight of dry matter of the tobacco extract contained in the reconstituted plant leaf is from 95:5 to 5:95.

4. The reconstituted plant leaf according to claim 1, in which the plant fibres represent from 40% to 75% by weight of dry matter of the reconstituted plant leaf.

5. The reconstituted plant leaf according to claim 1, in which the plant fibres and the plant extract are selected from spore-producing plants, seed-producing plants or a mixture thereof.

6. The reconstituted plant leaf according to claim 1, having a basis weight from 20 $g/m^2$ to 150 $g/m^2$.

7. The reconstituted plant leaf according to claim 1, further comprising particles selected from plant particles, tobacco particles, or a mixture thereof, wherein the particles represent from 5% to 65% by weight of dry matter of the reconstituted plant leaf.

8. The reconstituted plant leaf according to claim 1, in which the plant fibres represent from 50% to 60% by weight of dry matter of the reconstituted plant leaf.

9. The reconstituted plant leaf according to claim 1, in which the plant fibres, the plant extract, or both, comprise components from a rooibos plant.

10. The reconstituted plant leaf according to claim 1, wherein the fibrous substrate does not comprise whole plant leaves.

11. A mixture of reconstituted leaves/tobacco comprising tobacco and the reconstituted plant leaf of claim 1.

12. A papermaking process for making the reconstituted plant leaf of claim 1 comprising the following steps:

passing the plant fibres through a papermaking machine to constitute a plant base web; and incorporating the aerosol-generating agent and optionally the extract in the plant base web.

13. A blend of reconstituted leaves comprising the reconstituted plant leaf of claim 1 combined with a mixed reconstituted leaf comprising:

a fibrous substrate comprising tobacco fibres, an aerosol-generating agent, and plant extract, characterized in that the plant is not a tobacco plant and the aerosol-generating agent represents from 8 to 50% by weight of the dry matter of the leaf.

* * * * *